United States Patent [19]

Balling

[11] 4,057,368

[45] Nov. 8, 1977

[54] BASE FRAME CONSTRUCTION FOR A LIQUID RING COMPRESSOR SET

[75] Inventor: Heinz Balling, Erlangen, Germany

[73] Assignee: Siemens Aktiengesellschaft, Munich, Germany

[21] Appl. No.: 640,959

[22] Filed: Dec. 15, 1975

[30] Foreign Application Priority Data

Dec. 19, 1974 Germany ..... 2460268

[51] Int. Cl.[2] ..... F04B 39/16; F04C 19/00

[52] U.S. Cl. ..... 417/313; 418/100

[58] Field of Search ..... 55/307, 442; 417/68, 417/69, 313; 418/97, 98, 99, 100

[56] References Cited

U.S. PATENT DOCUMENTS

| | | | |
|---|---|---|---|
| 1,850,907 | 3/1932 | Andresen | 418/97 X |
| 1,870,734 | 8/1932 | Jennings | 417/69 |
| 2,070,151 | 2/1937 | Westin | 418/100 X |
| 3,291,385 | 12/1966 | Williams et al. | 418/99 X |

FOREIGN PATENT DOCUMENTS

| | | | |
|---|---|---|---|
| 116,014 | 10/1942 | Austria | 418/97 |
| 969,928 | 7/1958 | Germany | 417/313 |
| 393,977 | 6/1933 | United Kingdom | 418/87 |

*Primary Examiner*—Carlton R. Croyle
*Assistant Examiner*—Michael Koczo, Jr.
*Attorney, Agent, or Firm*—Kenyon & Kenyon, Reilly, Carr & Chapin

[57] ABSTRACT

A liquid ring compressor set including a base frame, fabricated of hollow sectional members on which the motor and compressor of the set are mounted, which functions as a liquid separator. The base frame is U-shaped and includes a pair of spaced-apart leg members each disposed in parallel relationship with respect to the compressor shaft of the set. A connecting member is coupled to corresponding ends of the leg members so as to form the U-shaped base frame configuration.

10 Claims, 5 Drawing Figures

BASE FRAME CONSTRUCTION FOR A LIQUID RING COMPRESSOR SET

BACKGROUND OF THE INVENTION

1. Field of the Invention

This invention relates generally to liquid ring compressors, and in particular to an improved base frame construction for a liquid ring compressor set.

2. Description of the Prior Art

Liquid ring compressor sets known in the art are generally designed so that the compressor pump and drive motor thereof are coupled to each other either directly or indirectly and are mounted on a common base plate. In one known compressor set, the base frame has a tubular configuration and is utilized to supply and discharge the compression medium. In addition, the base frame also functions as a liquid separator. Further details of such a compressor set are described in German Pat. No. 969,928. The disadvantage of such compressor sets, however, is that the cross-connections thereof allow only relatively short separator paths to be used compared to the total length of the compressor set.

SUMMARY OF THE INVENTION

It is therefore an object of the present invention to provide an improved base frame construction for a liquid ring compressor set which overcomes the aforementioned disadvantages of heretofore known apparatus and which is compact and sturdy, has long separator paths, and which, in addition, includes sufficient space for accommodating accessory compressor set components.

These and other objects of the invention are achieved in a liquid ring compressor apparatus including a base frame fabricated of hollow sectional members on which the motor and compressor of the apparatus are mounted, and in which the base frame thereof functions as a liquid separator. The improvement of the invention comprises a U-shaped base frame for the apparatus including a pair of spaced-apart leg members each disposed in parallel relationship with respect to the shaft of the compressor of the apparatus, and a connecting member coupled to corresponding ends of the leg members so as to form the U-shaped base frame configuration.

By constructing the base frame in a U-shaped configuration and utilizing the base frame as a liquid separator, high separator efficiencies are obtained with a compact design. This result can be achieved since the mixture ejected by the liquid ring pump has sufficient time to settle and thus to separate as it travels through the leg members and connecting member of the base frame. Moreover, in addition to the aforesaid favorable liquid separation effect, additional space in the compressor set is created by using the U-shaped base frame configuration. Thus, additional compressor set accessory components such as, for example, heat exchangers, can be accommodated in the apparatus. In the latter connection, it is preferable if an access opening is provided in the base frame opposite the connecting member so that the accessory components of the compressor set can be interchanged as desired, even after installation of the compressor set. Interchangeability of the compressor set accessory components are provided on the inside surfaces of the base frame leg members in the space formed therebetween.

In some liquid ring compressor sets, the height of the center of the shaft of the motor thereof is less than the height of the center of the shaft of the compressor, and the motor and compressor shafts are positioned on the same axis. In such sets, the space which remains beneath the motor of the apparatus is preferably used as a space for an additional preliminary and/or post liquid separator. Such a liquid separator may form part of the base frame of the compressor set. A droplet separator is preferably disposed in the additional liquid separator in order to remove, if required, any remaining liquid droplets in the mixture ejected by the compressor pump. This droplet separator is preferably a pull-out unit and is designed so as to function simultaneously as a sound absorber.

The base frame liquid separator is also preferably provided with means for monitoring and adjustably controlling the liquid level in the base frame, such as an intake and discharge control and regulator or level control. Such means assures trouble and maintenance-free operation of the compressor set over extended periods of time.

It should be noted that it is not necessary that all of the mixture ejected by the compressor pump flow through the liquid separator base frame at the same time. Rather, the individual leg members of the U-shaped base frame may, if desired, be subdivided and utilized as first and second preliminary and post liquid separator compartments.

These and other novel features of the inventive apparatus are described in greater detail in the following detailed description.

BRIEF DESCRIPTION OF THE DRAWINGS

In the drawings, wherein similar reference numerals denote similar elements throughout the several views thereof.

DETAILED DESCRIPTION

Figure 1:
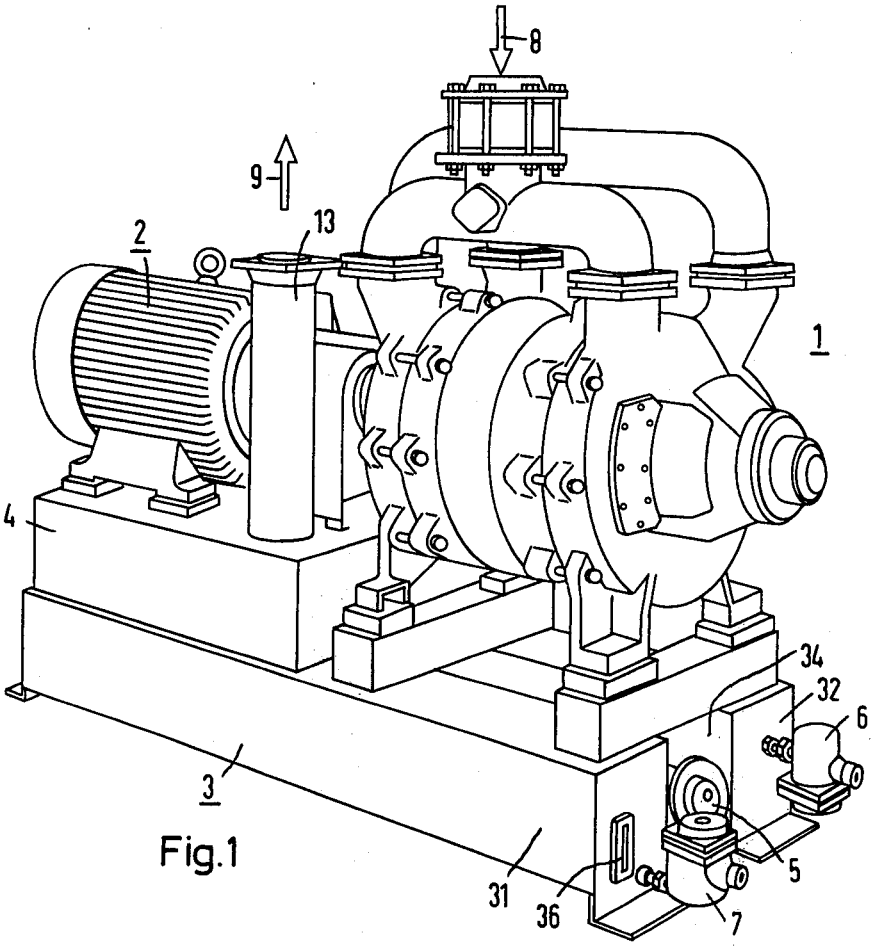
FIG. 1 is a perspective view of a liquid ring compressor set including an improved base frame constructed according to the invention.
Figure 2:
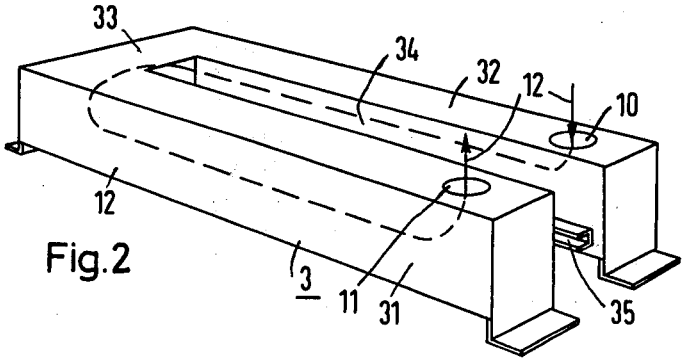
FIG. 2 is a perspective view of the base frame of the invention.

Referring now to the drawings, and in particular to FIGS. 1 and 2, there is shown a liquid ring compressor set including a liquid ring compressor 1 which is driven by an electric motor 2 coupled either directly or by means of a gear box or a belt drive to the compressor. Compressor 1 and motor 2 are mounted on a common base frame 3 which is fabricated from closed, hollow sections which are welded together in a U-shaped configuration. Base frame 3 forms and functions simultaneously as a liquid separator for the liquid ring compressor set. In the compressor set illustrated in the drawings, motor 2 has a lower shaft center height than liquid ring compressor 1 so that the space between base frame 3 and electric motor 2 can be utilized to contain an additional liquid separator 4.

In operation of the liquid ring compressor set, the compression medium which is to be pumped (which may comprise, for example, a steam-gas mixture) is drawn in through liquid ring compressor 1, is compressed, and is then ejected from the compressor together with another operating fluid taken from the liquid ring of the compressor. After this mixture leaves compressor 1, the gas thereof is for the most part separated from the moisture contained in the medium in the liquid separator, i.e., base frame 3. This gaseous mixture is then ejected from the compressor set by means of a sound absorbing exhaust outlet 13. The liquid collected in leg members 31 and 32 of the base frame is then partially returned by means of lines (not shown) to the liquid ring of the compressor 1. A selected liquid level is maintained in the base frame 3 by a liquid intake and discharge control, designated 6, 7. A sight glass 36 may be provided to permit optical control of the liquid level 39.

A heat exchanger 5 is mounted in the space formed between leg members 31 and 32 of base frame 3. This space is accessible from the front of the liquid ring compressor set through an opening provided opposite the connecting member 33 of the base frame. The heat exchanger cools the operating liquid of the liquid ring compressor 1. As shown in FIG. 2, the above-described liquid ring compressor set combines a compact design with relatively long liquid separation paths in base frame 3.

In the embodiment of the invention illustrated in the drawings, base frame 3 has a U-shaped configuration and is constructed from hollow sections having a rectangular cross-section. The base frame comprises a pair of leg members 31 and 32 and a connecting member 33 disposed transversely thereto and connected to corresponding ends of the leg members. Instead of the rectangular cross-sectional configuration of the base frame sections, other cross-sectional configurations, such as, for example, tubular, closed hollow sections, may, of course, also be utilized. Also, a non-rectangular transition connection between connecting member 33 and the leg members may be utilized, such as, for example, a coupling similar to a pipe elbow.

The liquid separator in the base frame operates basically as follows:

The liquid-gas mixture 12 which is ejected by liquid ring compressor 1 enters the interior space of leg 32 through an opening 10 provided in the top surface thereof. The mixture flows through the leg (as indicated by the dashed lines in FIG. 2), through connecting member 33 and leg member 31, and then exits from leg member 31 through another opening 11 provided in the top surface thereof. The mixture leaving the separator is then largely free of moisture present in the mixture as it enters opening 10.

As can be seen in FIG. 2, leg members 31 and 32 may have rail-like guide members 35 mounted on the inside surfaces thereof in the space formed therebetween for slidably mounting compressor set accessory components therein. Interchangeability of these accessory components is thereby facilitated.

Figure 3:
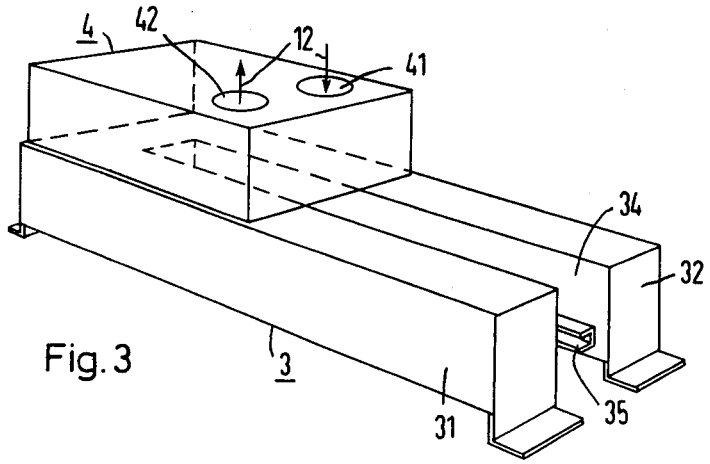
FIG. 3 is a perspective view of another embodiment of a base frame constructed according to the invention.

As shown in FIG. 3, the space beneath motor 2 of the compressor set may be utilized for an additional liquid separator 4. As illustrated therein, the gas-liquid mixture 12 which is to be dehumidified flows from compressor 1 into the additional separator 4 through an opening 41 provided in the top surface thereof. The mixture within separator 4 then flows into the base frame 3 through openings (also not shown) in the base frame. The dehumidified mixture 12 then exits from separator 4 through another opening 42 provided in the top surface thereof. The sound-absorbing exhaust outlet 13 illustrated in FIG. 1 is coupled to opening 42 of the separator 4; opening 41 thereof is coupled to the pressure side of the liquid ring compressor 1. It should be noted that for the sake of simplicity, the individual baffles utilized for directing the gas-liquid mixture have not been illustrated since liquid separators are known per se and the important aspect of the base frame described herein is the spatial disposition of the liquid separators with respect to the compressor pump and motor of the compressor set. In addition to the aforementioned advantages of the described arrangement, utilizing the space beneath the motor 2 and above the base frame 3 for the liquid separator 4 does not reduce the space 34 between the leg members 31 and 32 which accommodates the compressor set accessory components.

Figure 4:
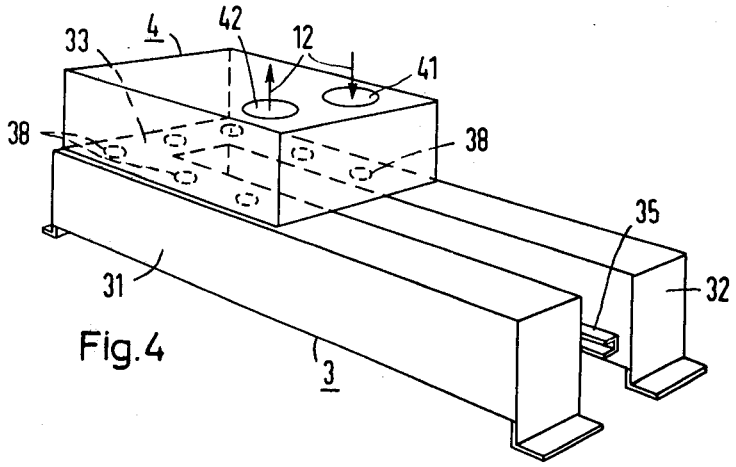
FIG. 4 is a perspective view of still another embodiment of a base frame constructed according to the invention.

FIG. 4 illustrates one possible flow design which may be utilized between the liquid separator 4 and base frame 3. In this embodiment of the base frame, mixture 12 ejected from compressor 1, enters liquid separator 4 through opening 41, and is directed by baffles (not shown) through openings 38 in leg members 31 and 32 and in connecting member 33 into base frame 3. The dehumidified mixture 12 exits from separator 4 through opening 42. If the size of openings 38 and the baffles utilized are suitably matched, mixture 12 is divided into one portion that flows in the leg members in base frame 3 and another portion which flows in the liquid separator 4. In each case, long liquid separation paths are provided.

Figure 5:
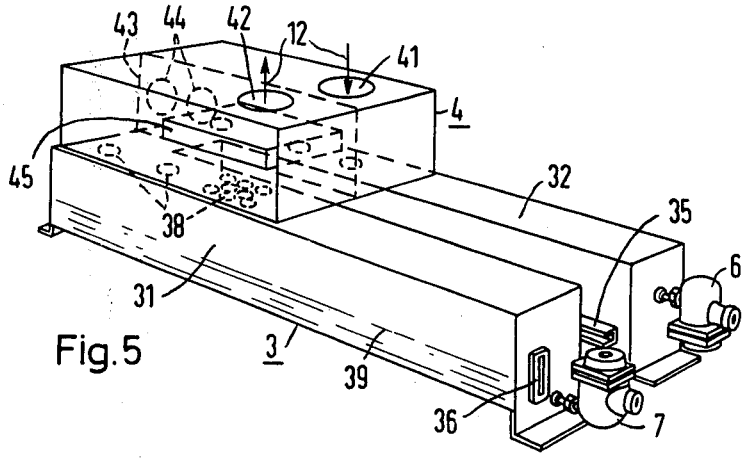
FIG. 5 is a perspective view of still a further embodiment of a base frame constructed according to the invention.

FIG. 5 schematically illustrates the design of the liquid separator 4 shown in FIG. 4. As shown in the drawings, that portion of separator 4 disposed above leg member 32 of the base frame is separated from the portion of liquid separator 4 disposed above leg member 31 by a partition member 43 having openings 44 disposed above connecting member 33. In addition, a plate-shaped droplet separator 45, which also functions as a sound absorber, is disposed in separator 4 below exhaust opening 42. Droplet separator 45 preferably comprises a pull-out, replaceable wire screen.

In the foregoing, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. In a liquid ring compressor set including a base frame fabricated of hollow sectional members in which a motor and compressor, each including a shaft, of the set are mounted, said compressor including an outlet, said base frame functioning as a liquid separator for said set, the improvement comprising a U-shaped base frame for said set including a pair of spaced-apart leg members each disposed in parallel relationship with respect to the shaft of said compressor of said set, and a connecting member coupled to corresponding ends of said leg members so as to form said U-shaped base frame, one of said leg members including at least one fluid inlet opening disposed in the top surface thereof coupled to said compressor outlet and the other of said leg members including at least one fluid outlet opening disposed in the top surface thereof, said compressor ejecting a fluid mixture into said inlet opening and said fluid mixture flowing through said base frame out of said compressor set through said outlet opening for separating moisture from said fluid mixture.

2. The liquid ring compressor set recited in claim 1, wherein said base frame includes a space between said leg members and an access opening between said leg members at the end of said base frame opposite said connecting member for permitting the installation of accessory components in said space of said base frame.

3. The liquid ring compressor set recited in claim 2, further comprising elongated guide members fastened to said leg members in said space of said base frame for slidably mounting said accessory components of said compressor therein.

4. The liquid ring compressor set recited in claim 1, wherein the height of the center of the shaft of said motor is less than the height of the center of the shaft of said compressor with respect to said base frame, and wherein said motor and compressor shafts are disposed on the same axis, and further comprising an additional liquid separator disposed on said base frame beneath said motor of said apparatus over said inlet and outlet openings in said base frame, said additional separator including an additional inlet opening coupled to said compressor outlet and an additional outlet opening disposed in the top surface thereof, said fluid ejected by said compressor flowing through said additional inlet opening into said additional separator and said base frame and out of said compressor set through said additional outlet opening.

5. The liquid ring compressor set recited in claim 4, wherein said additional liquid separator beneath said motor is coupled to and forms part of said base frame.

6. The liquid ring compressor set recited in claim 4, further comprising a droplet separator disposed in said additional liquid separator of said set.

7. The liquid ring compressor set recited in claim 6, wherein said droplet separator comprises a plate-shaped, pull-out droplet separator.

8. The liquid ring compressor set recited in claim 7, wherein said droplet separator comprises a wire screen which also functions as a sound absorber in said additional liquid separator.

9. The liquid ring compressor set recited in claim 1, further comprising means for monitoring and adjustably controlling the liquid level in said base frame.

10. The liquid ring compressor set recited in claim 1, wherein said leg members are subdivided so as to form first and second liquid separation compartments in said base frame.

* * * * *